US006145994A

United States Patent [19]

Ng

[11] Patent Number: 6,145,994

[45] Date of Patent: Nov. 14, 2000

[54] FLAT MULTIPLE TOOL HOLDER

[76] Inventor: Kelvin C. Ng, 26741 Portola Pkwy., Suite 1E-298, Foothills Ranch, Calif. 92610-1743

[21] Appl. No.: 09/262,640

[22] Filed: Mar. 4, 1999

[51] Int. Cl.[7] ..... F21V 33/00; B65D 85/00

[52] U.S. Cl. ..... 362/119; 362/154; 362/200; 30/152; 206/234; 206/374

[58] Field of Search ..... 362/115, 116, 362/119, 120, 154, 156, 200, 201; 7/118–120; 30/152, 156; 206/372–375, 234

[56] References Cited

U.S. PATENT DOCUMENTS

| | | | |
|---|---|---|---|
| D. 360,815 | 8/1995 | Padden | D8/105 |
| 4,466,561 | 8/1984 | Slaughter | 224/163 |
| 4,669,140 | 6/1987 | Miceli | 7/118 |
| 5,217,150 | 6/1993 | Chen | 224/163 |
| 5,328,026 | 7/1994 | Newman | 206/234 |
| 5,553,340 | 9/1996 | Brown, Jr. | 7/118 |
| 5,893,631 | 4/1999 | Padden | 362/201 |
| 6,009,582 | 1/2000 | Harrison et al. | 7/118 |

*Primary Examiner*—Alan Cariaso
*Attorney, Agent, or Firm*—Jones, Day, Reavis & Pogue

[57] ABSTRACT

A flat tool holder having a single pocket at one of its edges and a single tool body for insertion in said single pocket with a handle on the tool body for not only inserting and removing the tool from the single pocket but having at least one pocket therein for receiving at least one other tool.

9 Claims, 2 Drawing Sheets

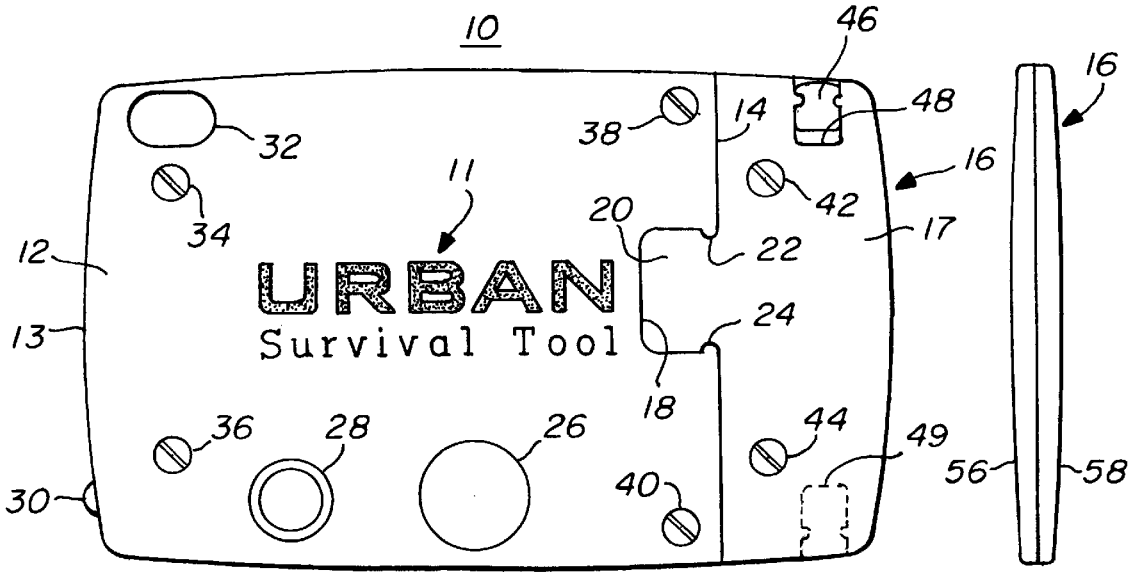
FIG. 1
FIG. 3
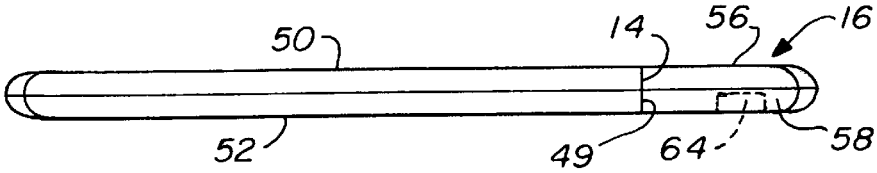
FIG. 2
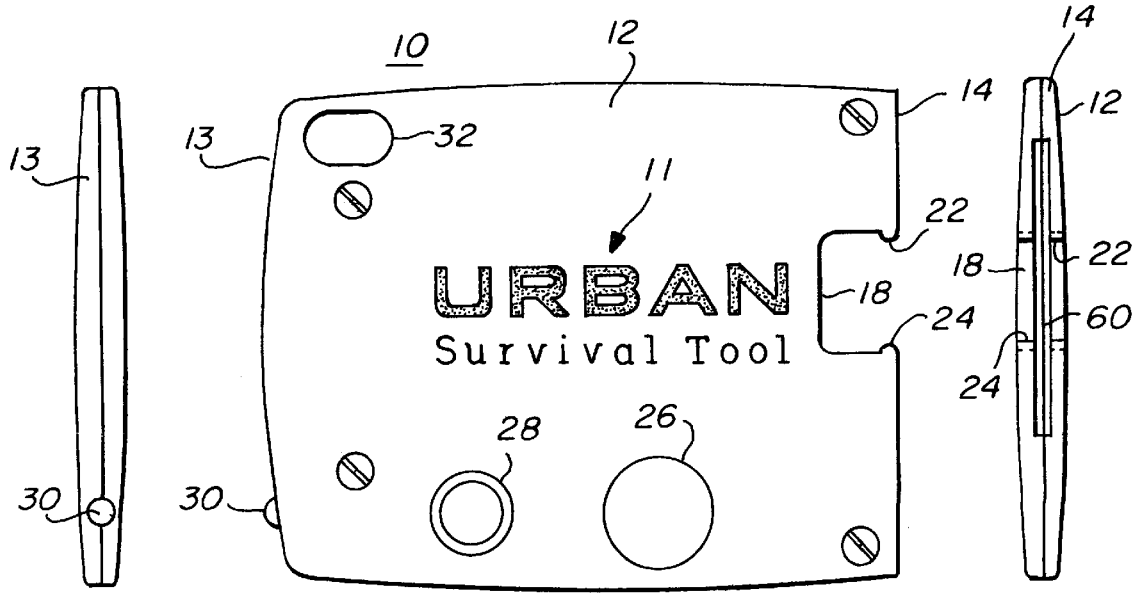
FIG. 6
FIG. 4
FIG. 5

FLAT MULTIPLE TOOL HOLDER

BACKGROUND OF THE INVENTION

1. Field of the Invention

The present invention generally relates to tool holders and specifically relates to a flat card-like tool holder that holds a multiple purpose tool.

2. Description of Related Art Including Information Disclosed Under 37 CFR 1.97 and 1.98

As stated in U.S. Pat. No. 5,328,026, many people desire to carry a number of different utensils or tools, such as a knife, bottle opener, nail file, screwdriver, mirror, toothpick, tweezers and the like in a pocket or handbag. However, it is difficult to locate one of such multiple tools in a handbag and, in addition, sharp edges thereon may cause injury.

The device disclosed in U.S. Pat. No. 5,328,026 discloses a multiple tool holder that is simple in construction, small in size, has a plurality of separate pockets in the interior of a substrate with each pocket being open at one of the opposite end edges, and shaped to match a profile of a given one of a plurality of different tools.

It would be advantageous to have a single tool in a single pocket in a flat card-like substrate with the single tool having a plurality of tool surfaces thereon.

SUMMARY OF THE INVENTION

The present invention discloses a flat multiple tool holder that has a generally flat card-like substrate with an interior and a plurality of edges including end edges. A single pocket is open at one of the end edges. A single tool body portion is inserted in the single pocket. There is a handle on the tool for inserting and removing the tool from the single pocket. Further, there is at least one pocket in the handle itself for receiving at least one other tool.

The tool body portion includes surfaces for defining a plurality of different tools. Further, when the tool is inserted in the single pocket, the handle thereon forms a substantially symmetrical tool holder with the card-like substrate.

In addition, the card-like substrate may include a magnifying lens and a light that can be selectively energized by depressing a switch on the substrate surface.

Additional pockets may be provided in the tool handle for accommodating additional tools and may include pockets on opposing sides of the handle that allow a tool such as a screwdriver to be inserted into the handle from each side.

The tool holder includes at least one indentation in an end edge of the single pocket and at least one corresponding mating projection on the tool handle for being received by the indentation when the single tool is inserted in the single pocket. Friction means are associated with the indentation and the mating projection for holding the single tool in the single pocket.

Thus, it is an object of the present invention to provide a flat multiple tool holder that has a single pocket being opened at one of the end edges and a single tool body portion for insertion in the single pocket and wherein the tool body portion includes surfaces defining a plurality of different tools.

It is still another object of the present invention to provide a flat tool holder that has a handle on the tool for inserting and removing the tool from the single pocket.

It is yet another object of the present invention to provide at least one pocket in the handle for receiving at least one other tool.

It is also an object of the present invention to provide a flat tool holder wherein the handle on the tool forms a substantially symmetrical tool holder with the card-like substrate when inserted in the single pocket.

It is also an object of the present invention to provide a flat tool holder that includes a magnifying lens and a selectively operable light.

Thus, the present invention relates to a flat tool holder comprising a generally flat card-like substrate having an interior and a plurality of end edges, a single pocket being opened at one of the end edges, a single tool body portion for insertion in the single pocket, a handle on the tool for inserting and removing the tool from the single pocket, and at least one pocket in the handle for receiving at least one other tool.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which:

FIG. 1 is a plan view of the novel tool holder of the present invention;

FIG. 2 is a side view of the flat tool holder of FIG. 1;

FIG. 3 is an end view of the substrate portion of the flat tool holder of FIG. 1 from the handle end;

FIG. 4 is a plan view of the substrate portion of the flat tool holder with the tool and handle removed and illustrating the projection for mating with the indentation on the on the flat substrate to hold the handle and tool in the substrate;

FIG. 5 is an end view of the handle end of the substrate portion of the flat tool holder;

FIG. 6 is an end view of the other end of the flat tool holder illustrating the light therein;

DETAILED DESCRIPTION OF THE PREFERRED EMBODIMENTS

Figure 7A:
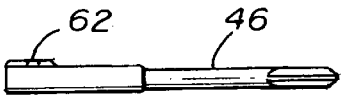
FIG. 7A is a side view of one of the screwdrivers that fits in the handle of the single tool.

FIG. 1 is a plan view of the novel flat tool holder 10. It has dimensions of approximately 90 mm by 56 mm by 5 mm. It has a flat card-like substrate 12 having an area 11 whereon information can be printed and it has end edges 13 and 14. End edge 14 has a single pocket 60 opened therein as will be shown later. A single tool 16 has a handle portion 17 with a single tool body portion 19 attached thereto as will be shown hereafter for insertion in the single pocket 60. The handle 17 allows the tool to be inserted and removed from the single pocket 60. In addition, handle 17 has at least one opening therein that can receive another tool. At least one indentation 18 is formed in the edge 14 of the single pocket. At least one corresponding mating projection 20 is formed on the tool handle 17 for being received by the indentation 18 when the single tool 16 is inserted in the single pocket 60. Projections 22 and 24 are very small and form friction means associated with the indentation 18 and the mating projection 20 for holding the single tool 16 in the single pocket. An orifice 32 allows the tool holder 10 to be attached to a key chain.

A magnifying lens 26 may be formed in the flat card-like substrate 12. In addition, an electrical switch 28 of any well-known type may be used as will be disclosed hereafter to selectively connect a battery to a light bulb 30, such as a light-emitting diode, projecting from the end 13 of the substrate 12.

As can be seen in FIG. 2, the substrate 12 may be formed in two halves 50 and 52 that are held together by screws 34, 36, 38, and 40 shown in FIG. 1. Alternatively, the screws may be replaced with rivets. In like manner, in the handle portion 17, screws 42 and 44 may be used to hold together two halves of the handle 56 and 58 as illustrated in FIG. 3. Again, alternatively, the screws may be replaced with rivets or other attaching means.

It will be noted in FIG. 1 that a tool 46 such as a screwdriver is inserted in pocket 48 in one side of handle 17 in a direction perpendicular to the direction in which the single tool is inserted in the pocket in end 14. Also as can be seen in FIG. 2, a second screwdriver 64 may be placed in a pocket 49 on the other side of the handle 17 in the opposite direction to, but spaced from, screwdriver 46 and shown in dotted lines in FIG. 1.

FIG. 4 is a plan view of the substrate 12 itself without the handle 17 and single tool body 19. All of the elements illustrated in FIG. 1 are shown in FIG. 4 except that the screws are not numbered.

FIG. 5 is an end view of one end 14 of the substrate 12 illustrating the opening or pocket 60 in which the single tool 16 is inserted by means of handle 17.

In FIG. 6, an end view of the other end 13 of the substrate 12, the light bulb or light-emitting diode 30 can be seen.

FIG. 7A is a side view of screwdriver 46 shown in FIG. 1 and illustrates a projecting surface 62 on the top thereof for facilitating removal of the screwdriver 46 from the slot or pocket 48 in the handle 17.

Figure 7B:
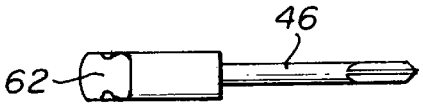
FIG. 7B is a plan view of the screwdriver of FIG. 7A.

FIG. 7B is a plan view of the screwdriver of FIG. 7A illustrating that it has a width greater than its thickness. This screwdriver may be, for example, a Phillips screwdriver.

Figure 8:
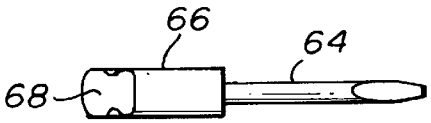
FIG. 8 is a plan view of a second screwdriver than can be placed in the opposite side of the handle.

FIG. 8 discloses a plan view of the other screwdriver 64 which may be a common screwdriver having a handle 66 and a raised portion or surface 68 thereon similar to that for screwdriver 46 shown in FIGS. 7A and 7B.

Figure 9:
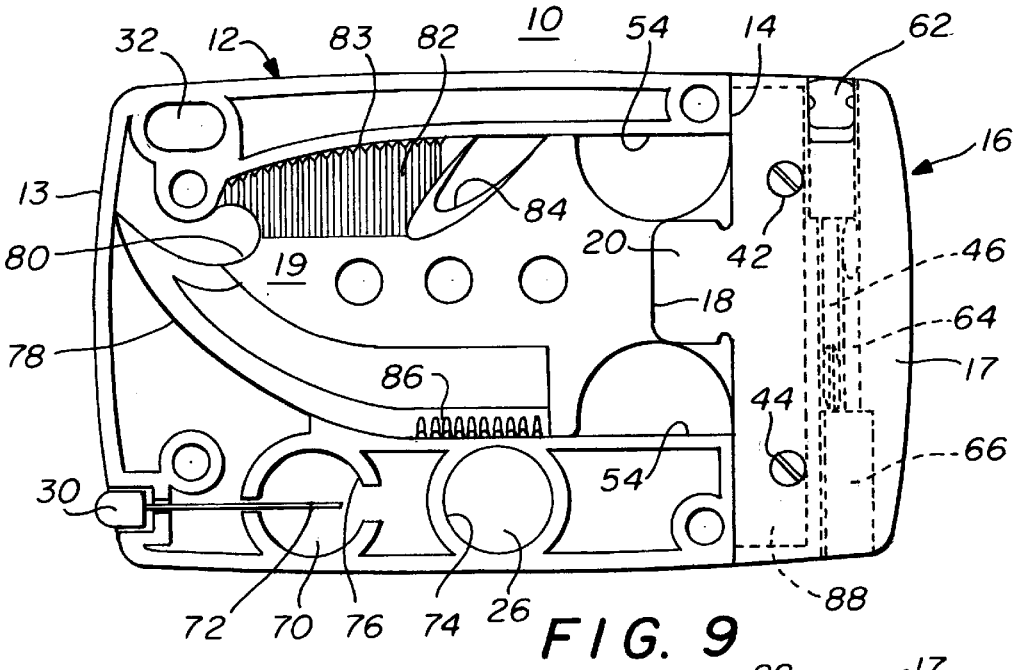
FIG. 9 is a plan view of the interior of the flat tool holder with the top cover of the substrate portion removed.

FIG. 9 is a plan view of the substrate 12 with the top 50 removed and illustrating the interior thereof. It can be seen that the pocket has walls 54 and is formed at edge 14 and has an opening at edge 14. The single tool 16 has a handle portion 17 and a body portion 19 attached to the handle portion 17 by means of tool portion 88. The single tool body portion 19 includes a knife blade 78, a can opener 80, a file 82 with saw blade 83 thereon, a hook knife 84 and a serrated edge 86. The diameter of the tool body portion 19 is such that it snugly fits in the pocket walls 54.

Also as can be seen in FIG. 9, the outer end portion 88 of the tool body 19 is attached to the handle 17 by means of screws or rivets 42 and 44. Also as can be seen in the handle 17 are the screwdrivers 46 and 64.

The magnifying lens 26 sits within walls 74 and battery 70 sits within walls 76. One of the electrical leads 72 from light 30 is shown above one of the battery terminals. The switch 28 shown in FIG. 1 and FIG. 4 can be depressed to cause the contact 72 to engage the terminal battery 70 in any well-known manner to selectively activate light 30.

Figure 10:
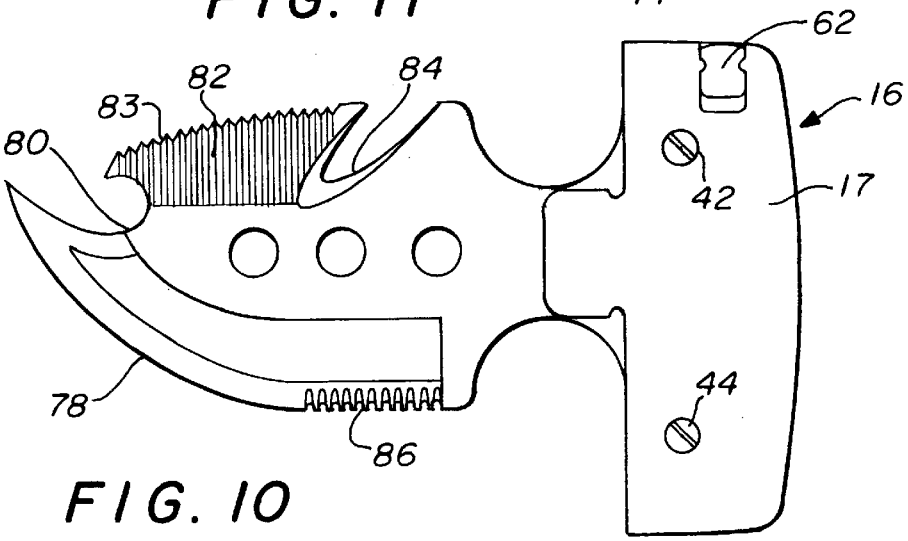
FIG. 10 is a plan view of the single tool body portion attached to the tool handle and illustrating the various tools on the body portion.

FIG. 10 is a plan view of the tool 16 including the outer end portion 88 in the handle 17. All of the details that were set forth in FIG. 9 of the blade itself are shown in FIG. 10.

Figure 11:
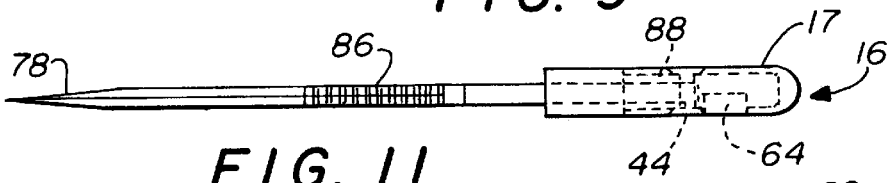
FIG. 11 is a side view of the tool body portion and handle illustrated in FIG. 10.

FIG. 11 is a side view of the tool 16 shown in FIG. 10 and illustrates the other screwdriver 64 in the handle 17 and outer end portion 88 that is held between handle portions 56 and 58 by screw 44.

Thus, there has been disclosed a novel tool holder having a generally flat card-like substrate with a single pocket being opened at one of the end edges. A single tool body portion is inserted in the single pocket. A handle on the single tool body portion is utilized for inserting and removing the tool body portion from the single pocket as well as containing additional pockets for the insertion of at least first and second other tools, such as screwdrivers. This tool is much simpler than those of the prior art in that it has only one tool body portion having multiple surfaces defining a plurality of different tools thereon. It also includes a light switch for energizing a light source that is important for use at night and has a magnifying lens. An orifice is provided for attachment to a device so that the small unit can be attached to the device with, for example, a key chain. The unit has a width of approximately 56 millimeters, a length of approximately 90 millimeters, a thickness at the thickest point in the center of 5 millimeters, and a thickness at the edges of 4 millimeters.

The corresponding structures, materials, acts, and equivalents of all means or step plus function elements in the claims below are intended to include any structure, material, or act for performing the function in combination with other claimed elements as specifically claimed.

What is claimed is:

1. A flat tool holder and tool body combination comprising:

a generally flat card-like substrate having an interior and end edges;

a single pocket being opened in the substrate at one of said end edges;

a single tool body distinct and unattached to said substrate for insertion in said single pocket in a direction perpendicular to the edge of said substrate defining the opening to said single pocket, said tool body including surfaces defining a plurality of different tools;

a handle on said tool body comprising first and second opposed portions extending perpendicular to said insertion direction to form a "T" shaped handle for inserting and removing said tool from said single pocket; and a pocket in at least one of said first and second opposed portions of said handle for receiving at least one other tool.

2. The tool holder and tool body combination of claim 1 wherein said handle on said tool forms a substantially symmetrical tool holder when inserted in the single pocket in said card-like substrate.

3. A flat tool holder comprising:

a generally flat card-like substrate having an interior and end edges;

single pocket begin opened in the substrate at one of said end edges;

a single tool body for insertion in said single pocket;

a handle on said tool body for inserting and removing said tool from said single pocket;

at least one pocket in said handle for receiving at least one other tool; and a magnifying lens in said card-like substrate adjacent said tool body.

4. A flat tool holder comprising:

a generally flat card-like substrate having an interior and end edges;

a single pocket being opened in the substrate at one of said end edges;

a single tool body for insertion in said single pocket;

a handle on said tool body for inserting and removing said tool from said single pocket;

at least one pocket in said handle for receiving at least one other tool;

a battery in said card-like substrate;

an orifice in one edge of said card-like substrate;

a light in said orifice;

a switch on said card-like substrate; and electrical leads coupled between said light, said switch, and said battery such that said switch can be selectively actuated to activate said light.

5. The tool holder and tool body combination of claim 1 wherein said tool handle defines first and second pockets in corresponding ones of said first and second opposed portions of said handle, each of said pockets receiving said other tools.

6. The tool holder and tool body combination of claim 5 further comprising:

a first screwdriver inserted in said first pocket in said tool handle; and a second screwdriver inserted in said second pocket in said tool handle.

7. The tool holder and tool body combination of claim 1 wherein said single tool body surfaces define each of a knife, a can opener, a saw blade, a hook knife, and a serrated edge.

8. The tool holder and tool body combination of claim 1 further comprising:

at least one indentation in an end edge of said single pocket;

at least one corresponding mating projection on said tool handle for being received by said indentation when said single tool is inserted in said single pocket; and friction means associated with said indentation and mating projections for holding said single tool in said single pocket.

9. The apparatus of claim 1 wherein at least one of said plurality of different tools is selected from a knife, a can opener, a saw blade, a hook knife and a serrated edge.

* * * * *